US007024898B1

(12) United States Patent
Zuber et al.

(10) Patent No.: US 7,024,898 B1
(45) Date of Patent: Apr. 11, 2006

(54) METHOD FOR HYDROFORMING A HOLLOW PROFILE

(75) Inventors: Armin Zuber, Meckesheim (DE); Alexander Hoffman, Bretzfeld (DE); Wulf Leitermann, Bad Wimpfen (DE); Klaus Koglin, Neckarsulm (DE); Jorg Hein, Steisslingen (DE); Lutz Kampmann, Beringen (DE)

(73) Assignees: Audi AG, (DE); Alcan Technology & Management AG, (DE)

( * ) Notice: Subject to any disclaimer, the term of this patent is extended or adjusted under 35 U.S.C. 154(b) by 869 days.

(21) Appl. No.: 09/674,667

(22) PCT Filed: Feb. 29, 2000

(86) PCT No.: PCT/EP00/01684

§ 371 (c)(1),
(2), (4) Date: Apr. 19, 2001

(87) PCT Pub. No.: WO00/53354

PCT Pub. Date: Sep. 14, 2000

(30) Foreign Application Priority Data

Mar. 6, 1999 (DE) ..... 199 09 925

(51) Int. Cl.
*B21D 26/02* (2006.01)

(52) U.S. Cl. ..... 72/61; 72/370.22

(58) Field of Classification Search ..... 72/58, 72/61, 370.06, 370.22, 370.26
See application file for complete search history.

(56) References Cited

U.S. PATENT DOCUMENTS 3,209,432 A * 10/1965 Cape ..... 72/177
5,557,961 A 9/1996 Ni et al.

FOREIGN PATENT DOCUMENTS

| | | |
|---|---|---|
| DE | 1452646 | 3/1969 |
| DE | 19740323 | 3/1999 |
| EP | 0795365 | 9/1997 |

* cited by examiner

*Primary Examiner*—Lowell A. Larson
(74) *Attorney, Agent, or Firm*—Stevens, Davis, Miller & Mosher, LLP

(57) ABSTRACT

A process as claimed for the invention for internal high-pressure reshaping of a hollow section (12) in a reshaping tool, a fluid being introduced under high pressure $P_1$ into a hollow section and this section having a transitional area with different wall thicknesses in the area of an edge (18 to 21) to be blocked, is characterized in that the shape selected for the hollow section (12) in the initial state is such that a thickened area (22 to 25) extends a certain distance from the edge (18 to 21) into the wall section (14, 16) with smaller wall thickness. As a result, constrictions can be avoided during reshaping and favorable edge geometries can be achieved (FIG. 2).

3 Claims, 1 Drawing Sheet

State of the Art

State of the Art

METHOD FOR HYDROFORMING A HOLLOW PROFILE

The invention relates to a process for internal high-pressure reshaping of a hollow section in a reshaping tool, a fluid being introduced into the hollow section under high pressure and this hollow section having a transitional area of varying wall thicknesses in an edge to be shaped.

Analogous systems of hollow sections shaped by internal high pressure are known in the state of the art. For example, DE 42 32 161 A1 describes a process for manufacture of a hollow piece by using a base element consisting of plates joined together at the edges; the plates may be of the same or different thicknesses. DE 43 20 656 A1 describes a process for manufacture of a tubular girder or the like, a tubular girder consisting of tubular sections of varying wall thickness being welded together.

DE 44 91 192 C2 discloses a process for internal high-pressure reshaping, one which provides (FIG. 5) that the frictional relationships in the cavity of the die may be affected in critical transitional areas, such as edges to be blocked. The surface of the die may be nitrided or treated in another manner in order to make lower coefficients of friction and thus targeted afterflow.

Internal high-pressure reshaping is also used, among other things, for calibration of extruded sections. As is to be seen from FIG. 1*a*, such extruded sections 1 often have wall sections 2 to 5 with walls of different thickness. Optionally a flange 6 is also molded onto the extruded section 1.

It has now been found in internal calibration of extruded sections 1 by means of high-pressure reshaping that undesirable deformations of the section occur in areas of blocked edges 7 to 10 with transitional areas of different wall thickness present there (FIG. 1*b*). This undesirable effect may be explained by the uneven flow movements of the material in internal high-pressure reshaping.

The hollow section 1 to which pressure is applied by a fluid under high pressure $P_1$ is not uniformly shaped initially, but rather assumes an uneven shape. As a result, the central areas of the wall sections 2 to 5 initially rest against the die of the tool (not shown here). The forces of friction applied to this tribological system impede smooth operation of the tool. Edges 7 to 10 are not, as desired, moved into the appropriate edge sections of the tool die, but rather more or less retain their position. In order to fill the edge area of the tool die completely in the final stage of the reshaping process, the material of the hollow section 1 now continues flowing reinforced from wall sections 3, 5 of smaller wall thicknesses, since less shape modification work is required there in comparison to wall sections 2, 4 with greater wall thicknesses. As a result, an additional constriction 11 is formed in the area of transition between a wall section 3, 5 and an edge 7 to 10. In addition, the blocking of the edge geometry is unfavorable, as is to be seen from the photomicrograph in FIG. 1*b*.

SUMMARY OF THE INVENTION

The object of the invention is to develop a procedure such that constrictions are prevented and favorable edge geometries are achieved in reshaping of hollow sections with wall sections of varying wall thicknesses.

The solution claimed for the invention is a process for internal high-pressure reshaping of a hollow section in a reshaping tool whereby a fluid is introduced into the hollow section. The hollow section has varying wall thicknesses in an edge to be blocked, wherein the shape of the hollow section has a thickening that extends from the corner edge to a certain distance into the wall section with a smaller thickness. The thickening in the corner section may correspond to that of wall sections having greater thickness. The seams between the thickening and the narrower wall are designed to be fluid.

BRIEF DESCRIPTION OF THE DRAWINGS

The preferred embodiments of the invention will now be described with reference to the drawings of which.

DETAILED DESCRIPTION OF THE INVENTION

Figure 1A:
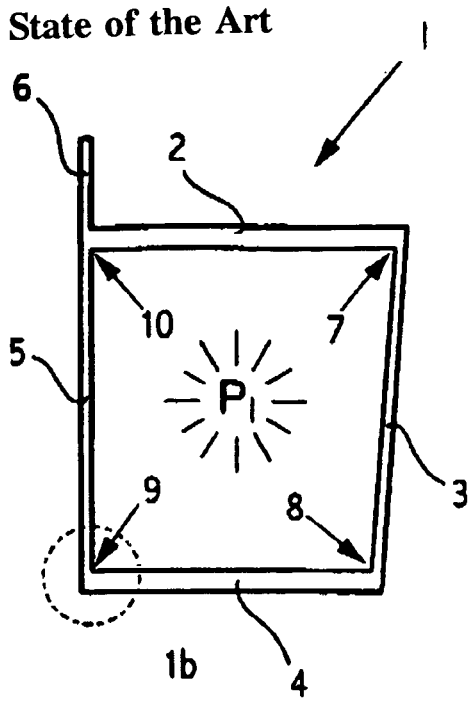
FIG. 1*a* is a sectional view of a conventional reshaping process for a hollow section.
Figure 1B:
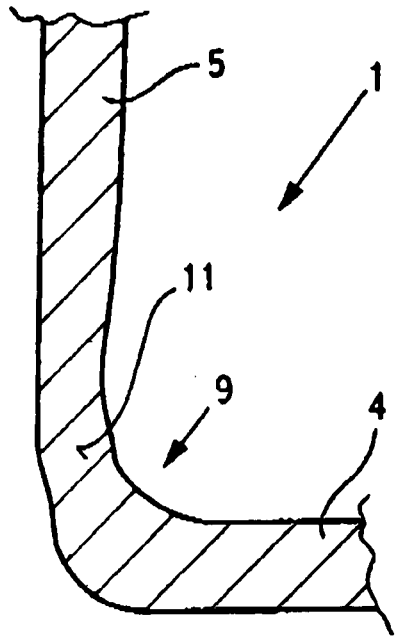
FIG. 1*b* is an enhanced view of a lower portion of the hollow section of FIG. 1*a* after conventional reshaping.
Figure 2A:
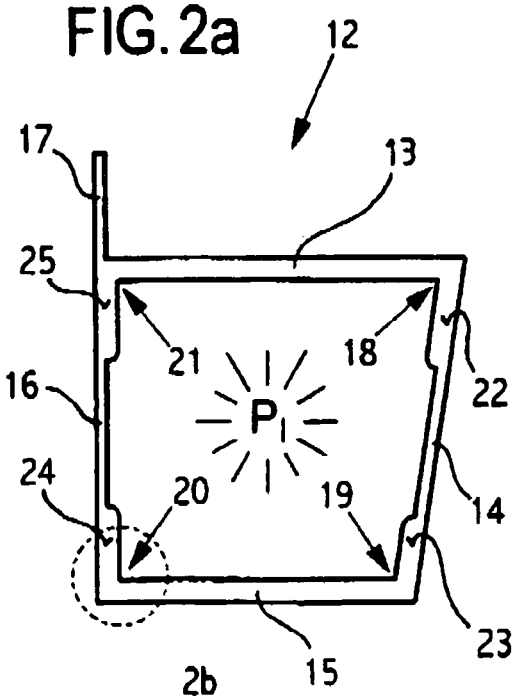
FIG. 2*a* is a sectional view of a reshaping process for a hollow section according to the present invention.
Figure 2B:
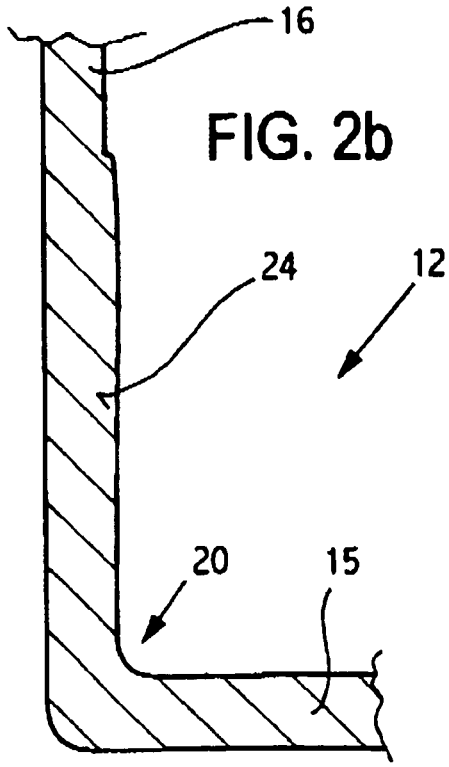
FIG. 2*b* is an enhanced view of a lower portion of the hollow section of FIG. 2*a* after reshaping according to the present invention.

One embodiment of the invention is illustrated in FIG. 2*a* on the basis of a hollow section in the form of an extruded section. FIG. 2*b* shows a pertinent photomicrograph.

The hollow section shown in FIG. 2*a* has wall sections 13 to 16 of different wall thicknesses. A flange 17 is also molded on the section. The shape selected for the hollow section 12 in the initial state, that is, before reshaping, is such that in the transitional area with different wall thicknesses, on edges 18 to 21, a thickening 22 to 25 extends a certain distance from these edges into the wall sections 14, 15 with smaller wall thicknesses. The wall thickness in this area 22 to 25 is preferably identical to that of the adjacent wall sections 13, 15 of greater wall thickness. The transitions between wall sections 13 to 16 and the thickenings 22 to 25 are preferably smooth ones.

As FIG. 2*b* shows, application of the measure claimed for the invention has prevented the development of constrictions. In addition, optimum edge geometry (with sharp edges) is obtained by such application.

The invention may be applied similarly when different wall thicknesses and identical edges to be shaped extend in the longitudinal direction of a hollow section to be reshaped by internal high-pressure reshaping.

What is claimed is:

1. A process for internal high-pressure reshaping of a hollow section in a reshaping tool comprising:

providing the hollow section with a plurality of adjacent faces having varying wall thicknesses meeting at corners thereof wherein in an initial state the wall thickness at each corner is thicker than and extending a certain distance into one adjacent face;

placing the hollow section into a tool die; and introducing a fluid into the hollow section under high pressure to block said corners.

2. A process as described in claim 1, wherein said wall thickness at said each corner resulting from the thickening corresponds to the thickness of another adjacent wall section of greater wall thickness than said one adjacent face.

3. A process as described in claim 1, wherein transitional areas between the adjacent faces and the corners are smooth.

* * * * *